US006548235B2

(12) United States Patent
Hudnall

(10) Patent No.: US 6,548,235 B2
(45) Date of Patent: Apr. 15, 2003

(54) STABILIZED SOLUTION OF AN ALKALI METAL OR ALKALINE EARTH METAL SALT OF P-PHENYLENEDIAMINE COLOR DEVELOPER AND METHOD OF MAKING SAME

(75) Inventor: Phillip Montgomery Hudnall, Kingsport, TN (US)

(73) Assignee: Eastman Chemical Company, Kingsport, TN (US)

( * ) Notice: Subject to any disclaimer, the term of this patent is extended or adjusted under 35 U.S.C. 154(b) by 0 days.

(21) Appl. No.: 09/982,627

(22) Filed: Oct. 18, 2001

(65) Prior Publication Data

US 2002/0072018 A1 Jun. 13, 2002

Related U.S. Application Data

(60) Provisional application No. 60/241,814, filed on Oct. 19, 2000.

(51) Int. Cl.[7] ..... G03C 7/413

(52) U.S. Cl. ..... 430/466; 430/490; 430/493

(58) Field of Search ..... 430/466, 490, 430/493

(56) References Cited

U.S. PATENT DOCUMENTS

| | | | | |
|---|---|---|---|---|
| 4,876,174 | A | 10/1989 | Ishikawa et al. | |
| 4,886,736 | A | * 12/1989 | Nakamura et al. | 430/359 |
| 4,892,804 | A | 1/1990 | Vincent et al. | |
| 5,273,865 | A | 12/1993 | Loiacono et al. | |
| 5,354,646 | A | 10/1994 | Kobayashi et al. | |
| 5,646,327 | A | 7/1997 | Burns et al. | |
| 5,660,974 | A | 8/1997 | Marrese et al. | |
| 5,702,873 | A | 12/1997 | Twist | |
| 5,709,982 | A | 1/1998 | Marrese et al. | |
| 5,723,268 | A | 3/1998 | Fyson | |
| 5,914,221 | A | 6/1999 | Kim et al. | |
| 6,017,687 | A | 1/2000 | Darmon et al. | |
| 6,020,113 | A | 2/2000 | Abe | |
| 6,077,651 | A | 6/2000 | Darmon et al. | |
| 6,228,567 | B1 | 5/2001 | Darmon et al. | |

FOREIGN PATENT DOCUMENTS

| | | |
|---|---|---|
| EP | 0 204 372 A1 | 12/1986 |
| EP | 0 434 097 A1 | 6/1991 |
| EP | 0 530 921 A1 | 3/1993 |
| EP | 0 793 141 A2 | 9/1997 |
| EP | 0 800 111 A1 | 10/1997 |

OTHER PUBLICATIONS

R. L. Bent et al., "Chemical Constitution, Electrochemical, Photographic and Allergenic Properties of ρ–Amino–N–di-alkylanilines," Journal of the American Chemical Society, 1951, pp. 3100–3125, vol. 73, United States.

Klaus J. Erdweg, "Molecular and Short–Path Distillation," Chemistry and Industry, May 2, 1983, pp. 342–345, United States.

JP 52033634, Chemical Abstracts 1967–2000/Aug. 25, published Mar. 14, 1977, Japan.

JP 57007139, Chemical Abstracts 1967–2000/Aug. 25, published Feb. 9, 1982, Japan.

JP 08268978, Chemical Abstracts 1967–2000/Aug. 25, published Oct. 15, 1996, Japan.

PL 161632, Chemical Abstracts 1967–2000/Aug. 25, published Jul. 30, 1993.

RO 76865, Chemical Abstracts 1967–2000/Aug. 25, published Jun. 22, 1981.

JP 06219997, Chemical Abstracts 1967–2000/Aug. 25, published Aug. 9, 1994, Japan.

JP 52144636, Chemical Abstracts 1967–2000/Aug. 25, published Dec. 2, 1997, Japan.

* cited by examiner

*Primary Examiner*—Hoa Van Le
(74) *Attorney, Agent, or Firm*—Jonathan Wood; Bernard J. Graves, Jr.

(57) ABSTRACT

A stabilized solution of an alkali metal or alkaline earth metal salt of N-ethyl-N-2-(methanesulfonylaminoethyl)-2-methyl-p-phenylenediamine includes from about 10 to 40 weight percent of an alkali metal or alkaline earth metal salt of N-ethyl-N-2-(methane sulfonylaminoethyl)-2-methyl-p-phenylene-diamine; from about 30 to 70 weight percent of at least one photographically inactive water-miscible or water-soluble hydroxy-containing, organic solvent of the alkali metal or alkaline earth metal salt of N-ethyl-N-2-(methane sulfonylaminoethyl)-2-methyl-p-phenylene-diamine; from about 5 to 40 weight percent water; and from about 1 to 40 weight percent of a preservative for the alkali metal or alkaline earth metal salt of N-ethyl-N-2-(methane sulfonylaminoethyl)-2-methyl-p-phenylene-diamine, wherein the weight percentages are based on the total weight of the stabilized solution. Another aspect of the invention are processes for making stabilized p-phenylenediamine color developer solutions.

Another embodiment is a stabilized aqueous solution of an alkali metal or alkaline earth metal salt of N-ethyl-N-2-(methanesulfonylaminoethyl)-2-methyl-p-phenylene-diamine having from about 10 to 40 weight percent of an alkali metal or alkaline earth metal salt of N-ethyl-N-2-(methane sulfonylaminoethyl)-2-methyl-p-phenylene-diamine; from about 20 to 88 weight percent water; and from about 1 to 40 weight percent of a preservative for the alkali metal or alkaline earth metal salt of N-ethyl-N-2-(methane sulfonylaminoethyl)-2-methyl-p-phenylene-diamine, wherein the weight percentages are based on the total weight of the composition. Another aspect of the invention are processes for making stabilized p-phenylenediamine color developer solutions.

38 Claims, No Drawings

STABILIZED SOLUTION OF AN ALKALI METAL OR ALKALINE EARTH METAL SALT OF P-PHENYLENEDIAMINE COLOR DEVELOPER AND METHOD OF MAKING SAME

CROSS REFERENCE TO RELATED APPLICATIONS

Benefit is claimed to the earlier filed application having U.S. Ser. No. 60/241,814 filed Oct. 19, 2000, the entire disclosure of which is incorporated herein by reference.

BACKGROUND OF THE INVENTION

1. Field of the Invention

The present invention relates to aqueous p-phenylenediamine-type photographic color developer compositions and methods for making p-phenylenediamine-type free-base photographic color developers in aqueous form. Specifically, the present invention relates to a useful p-phenylenediamine free base color developer in an aqueous alkali metal or alkaline earth metal salt form. More particularly, the present invention pertains to an alkali metal or alkaline earth metal salt composition of N-ethyl-N-2-(methanesulfonylaminoethyl)-2-methyl-p-phenylenediamine (CD-3) color developer.

The present invention further pertains to methods of making the p-phenylenediamine free base color developer in the aqueous alkali metal or alkaline earth metal salt form.

BACKGROUND OF THE INVENTION

The present invention relates to the manufacture of solutions of p-phenylenediamine-type photographic color developers in the free base form, i.e., a phenylenediamine devoid, or essentially devoid, of any acid addition salt of the phenylenediamine. p-phenylenediamine free bases have broad industry utility for the preparation of photographic finishing formulations which require a p-phenylenediamine color developer in the free base, rather than the salt, form.

The photographic finishing industry is comprised of three primary segments: the manufacture of photographic chemicals to supply photochemical formulators, the formulation of these chemicals into useful compositions for photochemical processing, and the processing of sensitized photographic color elements. Formulated photographic processing (photofinishing) solutions provided to the processors are complex, multi-part, multi-component mixtures, the specific compositions of which vary significantly according to the intended use and the formulator. Generally, the types of materials which are ultimately mixed and delivered to the processing bath include water; solubilizing agents, e.g., organic co-solvents; bases for pH control; color developing agents or color developers; preservatives; sequestering agents; buffering agents; clarifying agents; stain-reducing agents; anti-bacterial or anti-fungal agents; surfactants, and other function-specific materials.

The active component of the formulation which effects the formation of color upon processing (development) of the sensitized photographic color element (exposed film) is the free-base color developer. The color developers most commonly present in photofinishing compositions are p-phenylenediamine compounds such as N,N-dialkyl-p-phenylenediamines. These N,N-dialkyl-p-phenylenediamines vary in structure by substitution of the N-alkyl group or the ring. Specific examples of p-phenylenediamine color developers include N,N-diethyl-2-methyl-p-phenylenediamine monohydrochloride (CD-2), N-ethyl-N-2-(methanesulfonylaminoethyl)-2-methyl-p-phenylenediamine sesquisulfate monohydrate (CD-3), and N-ethyl-N-2-(hydroxyethyl)-2-methyl-p-phenylenediamine sulfate (CD-4), listed here in the commonly used acid salt form.

Traditionally, photographic finishing solutions have consisted of multiple parts which are mixed by the photographic processor or photofinisher just prior to use. Multiple parts are often required in order to separate and preserve the chemical activity and solubility of components that may otherwise deteriorate or react with each other when they are stored together for long periods of time under alkaline conditions. For example, one part might include a color developing agent in the form of an acid salt of a p-phenylenediamine color developer, specific examples of which are listed above, typically in the form of a stabilized aqueous solution. These solutions are acidic since the color developer is formulated in this part as the acid salt.

Another part typically contains a base or combination of bases which, upon mixing of the parts, serves to neutralize the acid associated with the part containing the color developer and to establish the desired alkalinity of the mixed color developing composition. Another part may contain agents to preserve the alkalinity of the mixed color developing composition. Still another part may include an optical brightener. Upon combination of all parts and water, a homogeneous color developing composition can usually be obtained for the working strength solution in the processing machine.

Other function-specific materials listed above may be incorporated in these or other parts to provide a homogenous color developing composition of appropriate working strength in the processing machine. Because the resultant and desired pH of the complete, mixed photographic finishing solution is alkaline, typically having a pH of from 9–13, the active color developer in the final, fully mixed, photographic finishing composition is not the acid salt of the color developer, but the corresponding free base. The term "free base" refers to phenylenediamine compounds devoid, or essentially devoid, of acid addition salts of phenylenediamines.

It is generally known that the concentrations of various photographic chemicals used in a photographic processing bath must lie within certain narrow limits in order to provide optimal performance. The most important solvent for such photo processing is water. Most inorganic salts can be readily dissolved in water while the organic photo chemicals in such processing baths usually have suitable solubility in water at the desired operating concentrations.

For these reasons, photofinishers prefer to use a single photo finishing solution composition which contains a plurality of the parts formerly kept separate to avoid undesired reactions and/or decomposition. Moreover, there has been a desire in the industry to provide compositions that can be used right out of their containers without the need for mixing various components (thereby reducing mixing errors), such as in what are known as "automatic replenishing" processors. The use of such combined photo finishing solutions results in simplicity of operation with a reduction in the potential for mixing errors, poor photo processing results and user need not pay for the transport or storage of large volumes of water.

The major incompatibility of the traditional parts of photo finishing solutions is between the acidic aqueous part, containing the acid salt of the color developer, and the alkaline part, containing the base or combination of bases. Since the active color developer in the final, mixed photo finishing composition is the free base form of the color developer, full consolidation of parts to produce a single-part formulation requires a source of p-phenylenediamine free base as the necessary ingredient.

Heretofore, p-phenylenediamine color developers in their free base form have not been available from the manufacturing segment of the industry. Accordingly, formulators have had to employ various procedures to produce the free bases from the corresponding p-phenylene acid salts. In preparing combined photo finishing solutions, formulators may form the p-phenylenediamine free base in situ as described in U.S. Pat. No. 5,273,865 from the p-phenylenediamine acid salt, leaving the neutralization products in the mixture. Alternatively, the p-phenylenediamine free base may be derived by neutralizing the corresponding acid salt followed by extraction into an organic solvent/water mixture, such as described in U.S. Pat. No. 6,017,687.

P-phenylenediamine free bases are intermediates to the preparation of p-phenylenediamine color developer acid salts and are manufactured commercially as non-isolated intermediates by the reduction of the corresponding nitroso or nitro precursors in polar solvents such as low molecular weight alcohols or ethers. For example, U.S. Pat. No. 3,920,739 discloses the catalytic hydrogenation of the corresponding nitro precursor in water, methanol, ethanol, n- or iso-propanol, dioxane, or dipropyl ether over a variety of noble metal catalysts. After completion of the reaction, the catalyst is removed by filtration and the N,N-disubstituted p-phenylenediamine is isolated by crystallization in the salt form by the addition of a mineral acid.

Japanese Patent Document JP 06-219997 discloses catalytic hydrogenation of the corresponding nitro compounds in ethanol over palladium-on-carbon catalyst, and isolation of the sulfate salts of the non-isolated free base intermediate.

Japanese Patent Document JP 52-144636 discloses catalytic hydrogenation in tetrahydrofuran over Raney nickel catalyst, and in dioxane over rhenium catalyst, and isolation of the sulfate salt of the non-isolated free intermediate.

Japanese Patent Document JP 57-007139 discloses catalytic hydrogenation in methanol over Raney nickel catalyst, and isolation of the sulfate salt of the non-isolated free base intermediate.

Methodologies for preparing p-phenylenediamine free base intermediates other than catalytic hydrogenation for the conversion of the corresponding nitroso or nitro intermediate to N,N-disubstituted p-phenylenediamines are also reported in the patent literature. For example, Japanese Patent Document JP 08-268978 discloses the reduction of nitroso precursors with hydrazine in water or isopropyl alcohol, and isolation of the mineral acid salt of the non-isolated free base intermediate.

The non-isolated free base subsequently is converted to the salt form by the addition of the appropriate acid and the salt is crystallized, isolated, and dried. The p-phenylenediamine free bases are not isolated, in part, because of the susceptibility of these materials to oxidation, and must be handled with the rigorous exclusion of oxygen to prevent rapid and extensive discoloration. Consequently, handling of the free bases during manufacture of the p-phenylenediamine acid salts, in the absence of any preservative, demands an inert atmosphere. Once the free-base color developer is converted to the acid salt, the color developer is significantly more stable to oxygen exposure.

One or more preservatives, or antioxidants, are routinely incorporated into formulated photofinishing solutions. Such preservatives are well-known in the art and may be inorganic or organic materials. The specific preservative/antioxidant used will depend upon the formulation and application. Examples of typical preservatives/antioxidants include sodium sulfite, potassium sulfite, sodium bisulfite, potassium bisulfite, sodium metabisulfite, potassium metabisulfite, carbonyl-sulfite adducts, hydroxylamine and hydroxylamine derivatives, hydroxamic acids, hydrazines, hydrazides, aminoketones, phenols, amino acids, mono- and polysaccharides, mono-, di-, and polyamines, ascorbic acid and derivatives, erythrobic acid and derivatives, alcohols, oximes, and nitroxy radicals.

Solubilizing agents, or organic co-solvents, are typically incorporated into formulated photofinishing solutions to increase the solubility of the free-base form of the color developing agent. Fitness-for-use requirements for solubilizing agents, in addition to the requisite ability to solubilize p-phenylenediamine free base in the principally aqueous medium, include water solubility, low odor, and environmental acceptability. Examples of these solubilizing agents include alcohols, glycols, polyols, ketones, and N,N-dimethylformamide.

SUMMARY OF THE INVENTION

Briefly, one aspect of the current invention is a p-phenylenediamine color developer composition wherein one embodiment is a stabilized color developer solution having: a) from about 10 to 40 weight percent of an alkali metal or alkaline earth metal salt of N-ethyl-N-2-(methane sulfonylaminoethyl)-2-methyl-p-phenylene-diamine; b) from about 30 to 70 weight percent of at least one photographically inactive water-miscible or water-soluble hydroxy-containing, organic solvent of the alkali metal or alkaline earth metal salt of N-ethyl-N-2-(methane sulfonylaminoethyl)-2-methyl-p-phenylene-diamine; c) from about 5 to 40 weight percent water; and d) from about 1 to 40 weight percent of a preservative, antioxidant or mixture thereof for the alkali metal or alkaline earth metal salt of N-ethyl-N-2-(methane sulfonylaminoethyl)-2-methyl-p-phenylene-diamine. The aforementioned weight percentages are based on the total weight of the stabilized solution.

Another embodiment of the composition is a stabilized, color developer solution having: a) from about 10 to 40 weight percent of an alkali metal or alkaline earth metal salt of N-ethyl-N-2-(methane sulfonylaminoethyl)-2-methyl-p-phenylene-diamine; b) from about 20 to 88 weight percent water; and c) from about 1 to 40 weight percent of a preservative, antioxidant or mixture thereof for the alkali metal or alkaline earth metal salt of N-ethyl-N-2-(methane sulfonylaminoethyl)-2-methyl-p-phenylene-diamine, wherein the weight percentages are based on the total weight of the stabilized solution.

Another aspect of the present invention is a process for preparing the above described stabilized aqueous solutions of the alkali metal or alkaline earth metal salt of N-ethyl-N-2-(methanesulfonylaminoethyl)-2-methyl-p-phenylenediamine compositions. In a first embodiment of the process, a stabilized p-phenylenediamine color developer solution is prepared by a direct hydrogenation process, which includes the steps of: a) hydrogenating 4-nitroso-3-methyl-N-ethyl-N-2-(methanesulfonylaminoethyl)aniline precursor compound under hydrogenation conditions of pressure and temperature and in the presence of a heterogeneous, hydrogenation catalyst and at least one photographically inactive, water-miscible or water-soluble, hydroxy-containing, organic solvent to obtain a mixture of the heterogeneous catalyst in a first solution having N-ethyl-N-2-(methanesulfonylaminoethyl)-2-methyl-p-phenylenediamine and solvent; b) separating the heterogeneous catalyst from the first solution; c) adding water and an alkali metal or alkaline earth metal hydroxide and/or carbonate to the first solution to obtain a second solution comprising an alkali metal or alkaline earth metal salt of N-ethyl-N-2-(methanesulfonylaminoethyl)-2-methyl-p-phenylenediamine in the solvent and water; and d) adding a preservative, antioxidant or combination thereof for the alkali metal or alkaline earth metal salt of N-ethyl-N-2-(methanesulfonylaminoethyl)-2-methyl-p-phenylenediamine to the second solution.

The color developing concentrate and method for its preparation offer a number of advantages over the CD-3 photochemical compositions currently available or known. The present invention provides a means for the direct manufacture of an alkali metal or alkaline earth metal salt of N-ethyl-N-2-(methane sulfonylaminoethyl)-2-methyl-p-phenylenediamine without having to prepare the alkali metal or alkaline earth metal salt of the color developer from the respective acid salt route. Direct manufacture of stable, color developer free base solution represents a significant improvement in the current technology used by formulators. Advantageously, performing the hydrogenation of step (a) in solvents compatible and useful in photographic developing solutions permits the direct and low cost manufacture of p-phenylenediamine free base solutions for supply to photochemical formulators. These solutions may be stabilized with one or more of a variety of antioxidants to provide protection from aerial oxidation.

In a second embodiment of the process of the present invention, a stabilized p-phenylenediamine free base color developer solution is prepared by: a) hydrogenating 4-nitroso-3-methyl-N-ethyl-N-2-(methanesulfonylaminoethyl) aniline in the presence of a hydrogenation catalyst and a solvent selected from alkanols containing 1 to 6 carbon atoms, ethers containing 2 to 6 carbon atoms and mixtures thereof under hydrogenation conditions of pressure and temperature to obtain a mixture of the heterogeneous catalyst in a first solution having N-ethyl-N-2-(methanesulfonylaminoethyl)-2-methyl-p-phenylenediamine and solvent; b) separating the heterogeneous catalyst from the first solution; c) adding water and an alkali metal or alkaline earth metal hydroxide and/or carbonate to the first solution to obtain a second solution comprising an alkali metal or alkaline earth metal salt of N-ethyl-N-2-(methanesulfonylaminoethyl)-2-methyl-p-phenylenediamine in the solvent and water; d) heating the second solution to distill the solvent; and e) adding a preservative, antioxidant or combination thereof for the alkali metal or alkaline earth metal salt of N-ethyl-N-2-(methanesulfonylaminoethyl)-2-methyl-p-phenylenediamine to the product of at least one of the steps (a)-(d).

In a third embodiment of the process of the present invention, a stabilized p-phenylenediamine free base color developer solution is prepared by: a) hydrogenating 4-nitroso-3-methyl-N-ethyl-N-2-(methanesulfonylaminoethyl)aniline in the presence of a hydrogenation catalyst and a solvent selected from alkanols containing 1 to 6 carbon atoms, ethers containing 2 to 6 carbon atoms and mixtures thereof under hydrogenation conditions of pressure and temperature to obtain a mixture of the heterogeneous catalyst in a first solution having N-ethyl-N-2-(methanesulfonylaminoethyl)-2-methyl-p-phenylenediamine and solvent; b) separating the heterogeneous catalyst from the first solution; c) crystallizing the N-ethyl-N-2-(methanesulfonylaminoethyl)-2-methyl-p-phenylenediamine to form a crystalline product; d) recovering the crystalline product from the solvent; e) adding water and an alkali metal or alkaline earth metal hydroxide and/or carbonate to the crystalline product to obtain a second solution comprising an alkali metal or alkaline earth metal salt of N-ethyl-N-2-(methanesulfonylaminoethyl)-2-methyl-p-phenylenediamine in water; and f) adding a preservative, antioxidant or combination thereof for the alkali metal or alkaline earth metal salt of N-ethyl-N-2-(methanesulfonylaminoethyl)-2-methyl-p-phenylenediamine to the second solution.

Surprisingly, it was discovered that formulating the p-phenylenediamine color developer in an alkali metal or alkaline earth metal salt of N-ethyl-N-2-(methanesulfonylaminoethyl)-2-methyl-p-phenylenediamine resulted in minimal loss in chemical stability of the p-phenylenediamine color developer free base, particularly when a preservative and/or an antioxidant was present. It has further been discovered that a free base solution can be directly prepared and packaged at a higher pH and maintain its stability.

DETAILED DESCRIPTION OF THE INVENTION

In preparing the stabilized solutions of an alkali metal or alkaline earth metal salt of N-ethyl-N-2-(methanesulfonylaminoethyl)-2-methyl-p-phenylenediamine of the present invention, the first step involves the reduction of a nitro or nitroso precursor compound of the p-phenylenediamine color developer free base in the presence of a solvent to obtain a solution of p-phenylenediamine free base. In accordance with the first process embodiment, the solvent is selected from a photographically inactive, water-soluble or water-miscible, hydroxy-containing organic solvent. The precursor compound is selected from 4-nitro-3-methyl-N,N-dialkylaniline compounds or 4-nitroso-3-methyl-N,N-dialkylaniline compounds wherein the alkyl groups are unsubstituted or substituted alkyl containing up to about 6 carbon atoms. Reduction of the precursor compounds produces the corresponding 4-amino-3-methyl-N-ethyl-N-(2-methanesulfonamidoethyl) aniline (CD-3 free base). Reduction of the precursor compound may be carried out using any chemical reduction technology known in the art suitable for this conversion. Preferably, the technology is catalytic hydrogenation under hydrogenation conditions of temperature and pressure using heterogeneous catalysis.

Typically, such hydrogenation techniques may be carried out at a temperature in the range of about 20° to 150° C., preferably about 35° to 70° C., and a total pressure in the range of about 0.3 to 103 bar gauge (barg) (approximately 5 to 1500 pounds per square inch—psig) preferably at a total pressure in the range of about 13.8 to 27.6 barg (approximately 200 to 400 psig).

The heterogeneous catalyst utilized in hydrogenating the nitro or nitroso precursor may be selected from a variety of known hydrogenation catalysts which are insoluble or substantially insoluble in the hydrogenation solvent. Examples of suitable catalysts include Raney nickel, Raney cobalt, platinum oxide, and palladium and platinum deposited on a catalyst support material, e.g., palladium-on-carbon, palladium-on-alumina, and platinum on alumina. The catalyst preferably is a supported palladium catalyst comprising about 1 to 5 weight percent palladium deposited on an alumina or carbon catalyst support. The amount of catalyst employed can vary significantly depending upon such factors as the particular catalyst and the hydrogenation conditions employed.

The photographically inactive, water-soluble or water-miscible, hydroxy-containing, organic solvent used in the hydrogenation step is preferably selected from solvents that are acceptable in photographic finishing (photofinishing) solutions. Formulated photofinishing solutions typically incorporate solubilizing agents, or organic co-solvents, to increase the solubility of the p-phenylenediamine free base color developing agent. Essential characteristics of the solvents which may be employed both in the hydrogenation step of our invention and in the formulation of photofinishing solutions include water solubility or miscibility, photographic inactivity, low odor, environmental friendliness and stability to the hydrogenation reaction, i.e., inertness. The suitable solvents also will have a relatively high solubility for the p-phenylenediamine color developer free base. Desirably, additional solvent characteristics include a flash point in excess of 37.8° C. (100° F.), low viscosity, and a melting point of less than 0° C. (32° F.). Examples of suitable hydrogenation solvents may be selected from alkanols containing 3 to 8 carbon atoms, such as 1-propanol, 2-propanol, 1-butanol, 2-butanol, 2-methyl-1-propanol, 1-pentanol, 2-pentanol, 3-methyl-1-butanol, and 3-methyl-2-butanol; glycols containing 2 to 8 carbon atoms, such as ethylene glycol, propylene glycol, 1,4-butanediol, 1,3-butanediol, 2-methyl-1,3-propanediol, 1,4-cyclohexanedimethanol, diethylene glycol, and triethylene glycol; polyethylene glycols, such as PEG-200, PEG-300, PEG-400, and PEG-600; glycol ethers containing 3 to 8 carbon atoms, such as 2-methoxyethanol, 2-ethoxyethanol, 2-propoxyethanol, 2-isopropoxyethanol, 2-butoxyethanol, 1-methoxy-2-propanol, 1-ethoxy-2-propanol, 3-methoxy-1-butanol, diethylene glycol monomethyl ether, diethylene glycol monoethyl ether, diethylene glycol mono-n-propyl ether, diethylene glycol mono-i-propyl ether, diethylene glycol monobutyl ether, and triethylene glycol monomethyl ether; dioxane; polyols such as glycerol; and polyol ethers containing 3 to 8 carbon atoms, such as 3-methoy-1,2-propanediol and 3-ethoxy-1,2-propanediol, and mixtures of these solvents. Preferably, the solvent employed in the hydrogenation step is selected from 2-propanol, 2-isopropoxyethanol, diethylene glycol, ethylene glycol, propylene glycol, PEG-200 and a mixture thereof.

The amount of solvent used may range from about 30 to 99 parts by weight, preferably about 60 to 75 parts by weight, per part by weight of precursor compound present. The stabilized solution of p-phenylenediamine free base color developer prepared in accordance with the present invention preferably contains about 10 to 40 weight percent, most preferably about 15 to 35 weight percent, p-phenylenediamine free base based on the total weight of the stabilized solution. If necessary, solvent may be added or removed, e.g., by vaporization under reduced pressure, to adjust the concentration of the p-phenylenediamine free base in the final, stabilized solution.

The concentration of the precursor nitroso or nitro compound in the hydrogenation solvent will dictate the concentration of the p-phenylenediamine free base color developer in the product solution. The workable concentration range of the precursor compound is from about 5 to 70 weight percent, the upper range being restricted by mass transfer considerations. In accordance with the present invention, the concentration of the nitroso or nitro precursor in the hydrogenation solvent preferably is about 10 to 50 weight percent, most preferably about 25 to 40 weight percent.

The product solution from the hydrogenation of the nitroso or nitro precursor invariably contains some amount of water since water is a by-product of the hydrogenation—one mole of water is produced for each mole of nitroso precursor hydrogenated and two moles of water are produced for each mole of nitro precursor hydrogenated. Furthermore, since the nitroso or nitro hydrogenation reactant typically is provided as a water-wet material, additional water is introduced into the hydrogenation and, consequently, into the product solution from the hydrogenation step. For example, the water-wet, nitroso or nitro hydrogenation reactant may contain from about 10 to 30 weight percent water.

Separating the heterogeneous catalyst from the first solution can be achieved using conventional separation techniques, such as filtering or centrifuging. A heat-stable preservative may be added at this point.

An alkali metal or alkaline earth metal hydroxide and/or carbonate and water, typically in an aqueous solution of the alkali metal or alkaline earth metal hydroxide or carbonate, is added to the product solution of N-ethyl-N-2-(methanesulfonylaminoethyl)-2-methyl-p-phenylenediamine of the hydrogenation step to obtain a second solution of an alkali metal or alkaline earth metal salt of N-ethyl-N-2-(methanesulfonylaminoethyl)-2-methyl-p-phenylenediamine in a mixture of the hydrogenation solvent and water. Although the alkali metal or alkaline earth metal hydroxide and/or carbonate and water may be added to the hydrogenation product solution prior to the separation of the heterogeneous catalyst, it is preferred that the alkali metal or alkaline earth metal hydroxide and/or carbonate and water be added subsequent to separating the hydrogenation catalyst from the product solution.

The amount of water added can vary from about 0 to about 3 parts by weight per part by weight, preferably about 0 to 0.2 parts by weight, per part by weight of solution of N-ethyl-N-2-(methanesulfonylaminoethyl)-2-methyl-p-phenylenediamine in the hydrogenation solvent. The conversion of the N-ethyl-N-2-(methanesulfonylaminoethyl)-2-methyl-p-phenylenediamine to its alkali metal or alkaline earth metal salt may be performed at a temperature of about 0 to 100° C., preferably at a temperature of about 20 to 60° C.

The CD-3 free base salt formed by the reaction of an alkali metal or alkaline earth metal hydroxide and/or carbonate with the acidic hydrogen of the methanesulfonylamino (or methanesulfonamide) group, i.e., the CD-3 free base alkali metal or alkaline earth metal salt, is the same compound as that formed when an acid addition salt of CD-3 or CD-3 free base is used in a photofinishing solution, which normally includes an alkali metal or alkaline earth metal hydroxide and/or carbonate and water. The amount of alkali metal or alkaline earth metal hydroxide base added, or their equivalent, is at least one-half equivalent per mole of CD-3 free base, typically about 1 to 1.5 equivalents of base per mole CD-3 free base. The base preferably is an alkali metal hydroxide selected from sodium hydroxide, potassium hydroxide and mixtures thereof, and, most preferably, potassium hydroxide.

A preservative and/or antioxidant is added to at least one of the solutions of steps (a)-(d) of the process. That is, the preservative may be added to the product solution, i.e., the first solution, desirably after separation of the heterogeneous catalyst; the second solution obtained by the addition of the water and an alkali metal or alkaline earth metal hydroxide and/or carbonate to the first solution; or to both. As used herein, the terms "preservative" and "antioxidant" are used interchangeably and are understood by one skilled in the photographic finishing art as a compound or composition that inhibits the degradation of the color developer composition. Examples of suitable preservatives or antioxidants include sodium sulfite, potassium sulfite, sodium bisulfite, potassium bisulfite, sodium metabisulfite, potassium metabisulfite, carbonyl-sulfite adducts, hydroxylamines, N,N-disubstituted hydroxylamines, and hydroxylamine derivatives, hydroxamic acids, hydrazines, hydrazides, aminoketones, phenols, amino acids, mono- and polysaccharides, mono-, di-, and polyamines, ascorbic acid and derivatives, alcohols, oximes, and nitroxy radicals. Preferred preservatives are selected from N,N-dialkylhydroxylamine, such as N,N-diethylhydroxylamine, (DEHA); ascorbic acid, erythrobic acid; an alkali metal sulfite, such as sodium sulfite and potassium sulfite; and mixtures of any two or more thereof. The concentration of the preservative in the stabilized solution of p-phenylenediamine free base color developer depends upon such factors as the particular preservative/antioxidant employed and the concentration of the color developer in the stabilized solution. Normally the concentration of the preservative will be in the range of about 1 to 40 weight percent, preferably from about 1 to about 30 weight percent, and more preferably from about 2 to about 15 weight percent, based on the total weight of the stabilized solution.

The resulting stabilized solution of the first process embodiment includes: a) from about 10 to 40 weight percent, and preferably from about 15 to 30 weight percent, of an alkali metal or alkaline earth metal salt of N-ethyl-N-2-(methane sulfonylaminoethyl)-2-methyl-p-phenylenediamine; b) from about 30 to 70 weight percent, and preferably from about 40 to 65 weight percent, of at least one photographically inactive water-miscible or water-soluble hydroxy-containing, organic solvent of the alkali metal or alkaline earth metal salt of N-ethyl-N-2-(methane sulfonylaminoethyl)-2-methyl-p-phenylene-diamine; and c) from about 5 to 40 weight percent, and preferably from about 5 to 25 weight percent, water; and d) from about 1 to 40 weight percent, preferably from about 1 to 30 weight percent, and more preferably from about 2 to 15 weight percent of a preservative, antioxidant or mixture thereof for the alkali metal or alkaline earth metal salt of N-ethyl-N-2-(methane sulfonylaminoethyl)-2-methyl-p-phenylenediamine, wherein the weight percentages are based on the total weight of the stabilized solution.

In the second process embodiment of the present invention, the stabilized p-phenylenediamine free base color developer solution is prepared by: a) hydrogenating 4-nitroso-3-methyl-N-ethyl-N-2-(methanesulfonylaminoethyl)aniline in the presence of a hydrogenation catalyst and a solvent selected from alkanols containing 1 to 6 carbon atoms, ethers containing 2 to 6 carbon atoms and mixtures thereof under hydrogenation conditions of pressure and temperature to obtain a mixture of the heterogeneous catalyst in a first solution having N-ethyl-N-2-(methanesulfonylaminoethyl)-2-methyl-p-phenylene-diamine and solvent; b) separating the heterogeneous catalyst from the first solution; c) adding an alkali metal or alkaline earth metal hydroxide and/or carbonate and water to the first solution to obtain a second solution comprising an alkali metal or alkaline earth metal salt of N-ethyl-N-2-(methanesulfonylaminoethyl)-2-methyl-p-phenylenediamine in the solvent and water; d) heating the second solution to distill the solvent; and e) adding a preservative, antioxidant or combination thereof for the alkali metal or alkaline earth metal salt of N-ethyl-N-2-(methanesulfonylaminoethyl)-2-methyl-p-phenylenediamine to the product of at least one of the steps (a)-(d).

Except for the use of a different hydrogenation solvent, steps (a)-(c) and (e) of the second process embodiment are carried out in the same manner as described relative to the first process embodiment above, i.e., using similar catalyst, hydrogenation conditions, amounts of materials, and the like; separation of the hydrogenation catalyst from the first solution and the addition of water and an alkali metal or alkaline earth metal hydroxide and/or carbonate to the first solution to obtain a second solution comprising an alkali metal or alkaline earth metal salt of N-ethyl-N-2-(methanesulfonylaminoethyl)-2-methyl-p-phenylenediamine in the solvent and water. Suitable solvents utilized in the hydrogenation step of the process second embodiment include methanol, ethanol, and tetrahydrofuran. Generally, such known hydrogenation solvents are not suitable for use in the preparation of photo finishing solutions because of flash points and/or environmental concerns. Alternatively, 1-propanol or 2-propanol may be used as the hydrogenation solvent. Advantageously, the propanols have a more favorable azeotrope with water than methanol, ethanol or tetrahydrofuran.

After removing the catalyst, the second solution is heated to distill from the hydrogenation solvent, i.e., the $C_1$–$C_6$ alkanol or $C_2$–$C_6$ ether. The amount of the $C_1$–$C_6$ alkanol or $C_2$–$C_6$ ether removed from the solution may vary from about 50 to 99 weight percent. Preferably from about 90 to 95 weight percent of the $C_1$–$C_6$ alkanol or $C_2$–$C_6$ ether is distilled from the solution. The amount of water added in this process embodiment is an amount which provides, after removal of some or all of the $C_1$–$C_6$ alkanol or $C_2$–$C_6$ ether hydrogenation solvent, a 10 to 40 percent by weight aqueous solution of an alkali metal or alkaline earth metal salt of N-ethyl-N-2-(methanesulfonylaminoethyl)-2-methyl-p-phenylenediamine.

The preservative may be added at any point in the process subsequent to the completion of the hydrogenation step of the process. For example, the preservative may be added to the first solution, desirably after separation of the heterogeneous catalyst. The preservative may, in addition to or in the alternative, be added the second solution obtained by the addition of the water and an alkali metal or alkaline earth metal hydroxide and/or carbonate to the first solution. The preservative may also, in addition to or in the alternative, be added after distillation of the hydrogenation solvent, or added in any combination thereof. The final stabilized solution composition may further be subjected to carbon treatment to reduce coloration of the final product solution.

The resulting stabilized solution of the second process embodiment includes: a) from about 10 to 40 weight percent, and preferably from about 15 to 30 weight percent, of an alkali metal or alkaline earth metal salt of N-ethyl-N-2-(methane sulfonylaminoethyl)-2-methyl-p-phenylenediamine; b) from about 20 to 88 weight percent, and preferably from about 15 to 75 weight percent, water; and c) from about 1 to 40 weight percent of a preservative, antioxidant or mixture thereof for the alkali metal or alkaline earth metal salt of N-ethyl-N-2-(methane sulfonylaminoethyl)-2-methyl-p-phenylene-diamine, wherein the weight percentages are based on the total weight of the stabilized solution. Although not preferred, the stabilized solution of the second process embodiment may further include up to about 10 weight percent of the $C_1$–$C_6$ alkanol or $C_2$–$C_6$ ether hydrogenation solvent.

In a third embodiment of the process of the present invention, a stabilized p-phenylenediamine free base color developer solution is prepared by: a) hydrogenating 4-nitroso-3-methyl-N-ethyl-N-2-(methanesulfonylaminoethyl)aniline in the presence of a hydrogenation catalyst and a solvent selected from alkanols containing 1 to 6 carbon atoms, ethers containing 2 to 6 carbon atoms and mixtures thereof under hydrogenation conditions of pressure and temperature to obtain a mixture of the heterogeneous catalyst in a first solution having N-ethyl-N-2-(methanesulfonylaminoethyl)-2-methyl-p-phenylenediamine and solvent; b) separating the heterogeneous catalyst from the first solution; c) crystallizing the N-ethyl-N-2-(methanesulfonylaminoethyl)-2-methyl-p-phenylenediamine to form a crystalline product; d) recovering the crystalline product from the solvent; e) adding water and an alkali metal or alkaline earth metal hydroxide and/or carbonate to the crystalline product to obtain a second solution comprising an alkali metal or alkaline earth metal salt of N-ethyl-N-2-(methanesulfonylaminoethyl)-2-methyl-p-phenylenediamine in water; and f) adding a preservative, antioxidant or combination thereof for the alkali metal or alkaline earth metal salt of N-ethyl-N-2-(methanesulfonylaminoethyl)-2-methyl-p-phenylenediamine to the second solution.

As described above for the second process embodiment, the hydrogenation step of the third process embodiment is carried out using similar catalyst, hydrogenation conditions, amounts of materials, and the like to produce a first solution. Alternatively and preferably, the hydrogenation is carried out using 2-propanol as the reaction solvent.

Similarly, the heterogeneous catalyst is separated or removed from the first solution using conventional separation techniques such as filtering and centrifuging.

After separating the heterogeneous catalyst from the first solution, the first solution is cooled to crystallize the N-ethyl-N-2-(methanesulfonylaminoethyl)-2-methyl-p-phenylenediamine. Crystallization of the p-phenylenediamine color developer is carried out using conventional methods known to those skilled in the crystallization and purification art. The crystallized material may be recovered or isolated by conventional liquid-solid separation techniques such as filtration, centrifugation or low temperature distillation.

The recovered crystallized product is combined with water and an alkali metal or alkaline earth metal hydroxide and/or carbonate to obtain a second solution comprising an alkali metal or alkaline earth metal salt of N-ethyl-N-2-(methanesulfonylaminoethyl)-2-methyl-p-phenylenediamine in water. The amount of hydroxide and/or carbonate typically used is as discussed above. The amount of water added in this embodiment is an amount which provides a 10 to 40 percent by weight aqueous solution of the alkali metal or alkaline earth metal salt of N-ethyl-N-2-(methanesulfonylaminoethyl)-2-methyl-p-phenylenediamine.

The preservative may be added at any point in the process subsequent to the completion of the hydrogenation step of the process, but desirably is added to the second solution.

The resulting stabilized solution of the third process embodiment includes: a) from about 10 to 40 weight percent, and preferably from about 15 to 35 weight percent, of an alkali metal or alkaline earth metal salt of N-ethyl-N-2-(methane sulfonylaminoethyl)-2-methyl-p-phenylenediamine; b) from about 20 to 88 weight percent, and preferably from about 15 to 75 weight percent, water; and c) from about 1 to 40 weight percent, and preferably from about 2 to about 15 weight percent, of a preservative, antioxidant or mixture thereof for the alkali metal or alkaline earth metal salt of N-ethyl-N-2-(methane sulfonylaminoethyl)-2-methyl-p-phenylene-diamine, wherein the weight percentages are based on the total weight of the stabilized solution. Although not preferred the stabilized solution of the second process embodiment may further include up to about 10 weight percent, and preferably less than about 4 weight percent of the $C_1$–$C_6$ alkanol or $C_2$–$C_6$ ether hydrogenation solvent.

The present invention is illustrated in greater detail by the specific examples presented below. It is to be understood that these examples are illustrative embodiments and are not intended to be limiting of the invention, but rather are to be construed broadly within the scope and content of the appended claims. The percentages given in the examples are by weight unless specified otherwise.

EXAMPLES

Solubility of p-phenylenediamine Free Base

The solubility of the free base form of color developers CD-3 in a number of potential solvents was determined. Representative solvents were selected from each of the different classes of solvents: alcohols, glycols and glycol ethers. A small quantity of a representative preservative, 3% of N,N-diethylhydroxylamine (DEHA), was added. Excess dry color developer free base (CD-3) was added to each solvent and saturation was achieved by mixing for several hours at room temperature. The saturation concentration in weight percent was determined by the techniques of both high pressure liquid chromatography (HPLC) and nuclear magnetic resonance (NMR), the results from each analytical method being quite comparable. Table I shows the saturation solubility of CD-3 free base at ambient temperature using a variety of solvents and solvent/water mixtures. In Table I, Solvent:Water refers to the weight:weight, solvent:water ratio when water was included, CD Free Base Concentration refers to the weight percent saturation concentration of CD-3, and PEG 200 and PEG 300 refers to poly(ethylene glycol) having an average molecular weight of 200 or 300.

TABLE I

| Example No. | Solvent | Solvent:Water | CD Free Base Conc. |
|---|---|---|---|
| 1 | 2-Isopropoxyethanol | — | 8.6 |
| 2 | 2-Methyl-1,3-Propanediol | — | 3.3 |
| 3 | 3-Methoxy-1-Butanol | — | 9.3 |
| 4 | PEG-200 | — | 16.9 |
| 5 | PEG-300 | — | 16.7 |
| 6 | Diethylene Glycol | — | 15.2 |
| 7 | Methanol | — | 23.6 |
| 8 | Methanol/Water | 90:10 | 18.9 |
| 9 | Methanol/Water | 50:50 | 6.8 |
| 10 | Methanol/Water | 10:90 | 0.7 |
| 11 | Ethanol | — | 5.4 |
| 12 | Ethanol/Water | 90:10 | 9.7 |
| 13 | Ethanol/Water | 50:50 | 9.0 |
| 14 | Ethanol/Water | 10:90 | 0.6 |
| 15 | 2-Propanol | — | 1.8 |
| 16 | 2-Propanol/Water | 90:10 | 7.8 |
| 17 | 2-Propanol/Water | 50:50 | 9.2 |
| 18 | 2-Propanol/Water | 10:90 | 0.8 |

Because CD-3 free base can be converted to its metal salt by treatment with a sufficiently strong base such as an alkali metal or alkaline earth metal hydroxide, carbonate, alkoxide or hydride, the solubility of CD-3 free base in solvent systems in combination with water and base was measured to determine if enhanced solubility could be obtained. The saturation concentration in weight percent again was determined by the techniques of both HPLC and NMR. Since the results obtained from the two methods were very comparable, only the HPLC data are shown in Table II. Selected solvents were combined with water and an alkali metal hydroxide (sodium hydroxide), with each sample containing a small quantity (3 weight percent) of a representative preservative (DEHA). Excess, dry CD-3 free base was added to each combination solvent system and saturation was achieved by mixing for several hours at ambient temperature. The results are shown in Table II. In Examples 19–24, the solvent:water:sodium hydroxide weight ratio was 63:34:3; Examples 25–30 solvent:water:sodium hydroxide weight ratio was 61:33:6; and Example 31 shows the saturation concentration of CD-3 free bases in a water/NaOH solution in a water:NaOH weight ratio of 93.5:6.5.

TABLE II

| Example No. | Solvent | CD Free Base Conc. |
|---|---|---|
| 19 | 2-Isopropoxyethanol/Water/NaOH | 22.9 |
| 20 | 2-Methyl-1,3-Propanediol/Water/NaOH | 19.0 |
| 21 | 3-Methoxy-1-Butanol/Water/NaOH | 21.3 |
| 22 | PEG-200/ WaterfNaOH | 19.5 |
| 23 | PEG-300/ Water/NaGH | 19.2 |
| 24 | Diethylene Glycol/ Water/NaOH | 15.1 |
| 24 | 2-Isopropoxyethanol/Water/NaOH | 21.9 |
| 26 | 2-Methyl-1,3-Propanediol/Water/NaOH | 23.2 |
| 27 | 3-Methoxy-1-Butanol/Water/NaOH | 26.4 |
| 28 | PEG-200/Water/NaOH | 23.5 |
| 29 | PEG-300/Water/NaOH | 20.8 |
| 30 | Diethylene Glycol/Water/NaOH | 21.9 |
| 31 | Water/NaOH | 25.1 |

The data in Table II demonstrates that a combination solvent system with organic solvent, water, and base significantly improved solubility of the CD-3 free base. High solubility of the color developer free base is important to the overall process economics, to avoid shipment of large quantities of solvents in supplying a solution product to photofinishing formulators.

Preparation of the Free Base of p-phenylenediamine Color Developer

4-Nitroso-3-methyl-N-ethyl-N-(2-methanesulfonamidoethyl)aniline (CD-3 nitroso) was catalytically hydrogenated using the solvents, temperatures (Temp ° C.), pressures (Press psig), and times (Time, minutes) set forth in Table III to produce solutions of CD-3 free base. CHDM-90 is a mixture consisting of 90% 1,4-cyclohexanedimethanol and 10% water. Hydrogenation was performed in a Paar 300 ml autoclave with a single-speed, hollow-shaft impeller having an inlet at the top. This allowed mixing of the gases in the head space with reaction liquid. Hydrogen was fed to the autoclave through a dip tube that extended to the bottom. At completion of the reaction, the dip tube was used to drain the reaction mixture through a heated in-line filter and into a nitrogen-purged, three-neck, receiving flask. This eliminated exposure of the product to oxygen. The autoclave also contained a thermocouple and cooling coil along with an opening in the head for depressurization, all surrounded by an electric heating mantle.

The autoclave was charged with 110.5 ml of solvent, (as indicated in Table I below), 58.0 g (dry weight basis) of nitroso or nitro precursor compound, and 0.59 g of 5% palladium-on-alumina catalyst. The nitroso or nitro precursor compound is used water-wet, nominally 90% solids. The impeller was started and the autoclave was purged 3 times with nitrogen and then purged 3 times with 10.3 barg (150 psig) hydrogen. The autoclave then was pressurized to 10.3 barg (150 psig) with hydrogen and then heated to 35° C. to initiate reaction. Hydrogenation was carried out until hydrogen uptake ceased. The autoclave was maintained at the final temperature and pressure for 1 additional hour. The temperature and pressure then increased to 65° C. and 34.5 barg (500 psig) and maintained for 1 additional hour after hydrogen uptake ceases. The temperature of the autoclave was lowered to 50° C. and vented. The autoclave was then purged 3 times with nitrogen. The hydrogenation product solution was discharged to a receiver flask optionally containing a preservative or combination of preservatives.

TABLE III

| Example No. | Solvent | Temp. (° C.) | Pressure (psig) | Time (min) |
|---|---|---|---|---|
| 32 | 2-Propanol | 35 | 150 | 150 |
| 33 | 2-Propanol | 35 | 150 | 150 |
| 34 | 2-Propanol | 35 | 150 | 150 |
| 35 | 2-Propanol | 35 | 150 | 150 |
| 36 | 2-Methyl-1,3-Propanediol | 65 | 150 | 150 |
| 37 | 2-Isopropxyethanol | 35 | 270 | 300 |
| 38 | 3-Methoxy-1-Butanol | 35 | 150 | 90 |
| 39 | DiethyleneGlycol | 65 | 500 | 330 |
| 40 | PEG-300 | 65 | 500 | 330 |
| 41 | 2-Propanol | 35 | 150 | 270 |
| 42 | 2-Isopropoxyethanol | 65 | 500 | 900 |
| 43 | 2-Isopropoxyethanol | 35 | 150 | 330 |
| 44 | CHDM-90 | 65 | 500 | 390 |
| 45 | 2-Isopropoxyethanol | 35 | 500 | 330 |
| 46 | PEG-200 | 65 | 500 | 300 |
| 47 | Diethylene Glycol | 35 | 150 | 360 |
| 48 | 2-Isopropoxyethanol | 35 | 150 | 315 |
| 49 | 2-Isopropoxyethanol | 35 | 150 | 333 |
| 50 | 2-Isopropoxyethanol | 35 | 150 | 324 |
| 51 | PEG-200 | 58 | 250 | 309 |
| 52 | 50/50 PEG-200/2-Propanol | 58 | 500 | 300 |

The examples of Table III illustrate the use of representative alcohol, glycol, glycol ether, and polyol solvents. Each solvent produced satisfactory results for the catalytic hydrogenation with some modification in the hydrogenation conditions. The loading of the nitroso precursor compound is such that the solution of the color developer free base resulting from the hydrogenation generally is 30 to 40%, depending primarily upon the density of the solvent. Preservatives utilized include DEHA, ascorbic acid, and sodium sulfite in amounts which gave a stabilized color developer free base containing 1 to 40 weight percent, preferably 1 to 30 weight percent, and most preferably from 2 to 15 weight percent, of the preservative.

Since the solubility data of Table I show that the saturation concentration of the p-phenylenediamine free base color developer generally is less than the concentration of the product solution exiting the autoclave, the receiving flask usually was charged with additional solvent to maintain a solution after cooling to ambient temperature. PEG-200 was utilized in some examples, as well as water and caustic. Many of these free base solutions also were treated with activated carbon to reduce the final solution color.

The following examples illustrate the embodiment of the process of the present invention wherein a nitro or nitroso precursor is hydrogenated in the presence of a $C_1$–$C_6$ alkanol and/or a $C_2$–$C_6$ ether solvent.

Example 53

A 425 gram autoclave solution containing 23.2% CD-3 free base, 2.5% DEHA in 268 g of 2-propanol, and 47 g of water was added to a two-liter flask equipped with an overhead agitator, temperature probe, addition funnel, condenser with take-off provision, and nitrogen blanketing. Water (275 g) and 30 g of 50% aqueous sodium hydroxide were added to the flask. The mixture was distilled at a vapor temperature of approximately 85° C. The final product solution contained nominally 23% CD-3 free base sodium salt, and remained in solution at ambient temperature.

Although the hydrogenation of the nitroso (or nitro) precursor was carried out in 2-propanol, methanol or ethanol are satisfactory substitutes. The product solution of the color developer free base is clarified into a distillation flask which may contain an antioxidant or preservative. After the solvent exchange is complete, the solution may optionally be treated with activated carbon to reduce color. The results clearly demonstrate the utility of the process technology for the manufacture of Color Developer Free Base solutions.

In the third embodiment of the process, the nitro or nitroso precursor is hydrogenated under conditions previously described and the color developer free base is isolated by crystallization and separation from the autoclave solution after removal of the heterogeneous hydrogenation catalyst. The hydrogenation solvent preferably is 2-propanol. The solubility data reported in Table I for CD-3 free base illustrate the superiority of 2-propanol, since CD-3 free base exhibits low solubility in and highest product recovery from 2-propanol. The crystallization process is illustrated by Examples 50 and 51.

Example 54

A 1264 g autoclave solution containing 23.9% CD-3 free base (296 g), 1.9% DEHA (24 g) in 802 g of 2-propanol, and 142 g water was added to a two-liter flask equipped with an overhead agitator, temperature probe, and nitrogen blanketing. The solution was cooled to 23° C. to crystallize the CD-3 free base. The CD-3 free base was collected by filtration at 23° C. and dried to give 191.2 g CD-3 free base having a purity of 98.2%. The filtrate was further cooled to 2° C. to isolate additional CD-3 free base which was collected by filtration at 23° C. and dried to give an additional 61.2 g of CD-3 free base. The total recovery of CD-3 free base is 85.3%.

Example 55

A 450 g autoclave solution containing 21.1% CD-3 free base (89 g), 2.4% DEHA (10 g) in 273 g of 2-propanol, and 48 g water was added to a one-liter flask equipped with an overhead agitator, temperature probe, and nitrogen blanketing. The solution was cooled to 2° C. to crystallize the CD-3 free base. The CD-3 free base was collected by filtration at 2° C. and dried to give 78 g CD-3 free base having a purity of 98.2% by HPLC area percent, providing a recovery of CD-3 free base of 87.6%.

The product from Examples 54 and 55 was dried to determine the recovery rate accurately. Dissolution of the isolated, solvent-wet solids, typically about 80–90 weight percent solids, in any solvent suitable for use in the preparation of photofinishing solutions is easily and simply effected. This dissolution is accompanied with the addition of a suitable preservative or combination of preservatives. For water/alkali metal hydroxide and/or carbonate solutions, inorganic sulfites, bisulfites and/or metabisulfites are preferably used.

Having described the invention in detail, those skilled in the art will appreciate that modifications may be made to the various aspects of the invention without departing from the scope and spirit of the invention disclosed and described herein. It is, therefore, not intended that the scope of the invention be limited to the specific embodiments illustrated and described but rather it is intended that the scope of the present invention be determined by the appended claims and their equivalents. Moreover, all patents, patent applications, publications, and literature references presented herein are incorporated by reference in their entirety for any disclosure pertinent to the practice of this invention.

What is claimed is:

1. A stabilized solution of an alkali metal or alkaline earth metal salt of a p-phenylenediamine color developer comprising:

a. from about 10 to 40 weight percent of an alkali metal or alkaline earth metal salt of N-ethyl-N-2-(methane sulfonylaminoethyl)-2-methyl-p-phenylenediainine;

b. from about 30 to 70 weight percent of at least one photographically inactive water-miscible or water-soluble hydroxy-containing, organic solvent of the alkali metal or alkaline earth metal salt of N-ethyl-N-2-(methane sulfonylaminoethyl)-2-methyl-p-phenylenediamine;

c. from about 5 to 40 weight percent water; and d. from about 1 to 40 weight percent of a preservative for the alkali metal or alkaline earth metal salt of N-ethyl-N-2-(methane sulfonylaminoethyl)-2-methyl-p-phenylenediamine and wherein the weight percentages are based on the total weight of the stabilized solution.

2. The stabilized solution of claim 1 wherein said hydroxy-containing organic solvent is selected from the group consisting of 1-propanol, 2-propanol, 1-butanol, 2-butanol, 2-methyl-1-propanol, 1-pentanol, 2-pentanol, 3-methyl-1-butanol, and 3-methyl-2-butanol, ethylene glycol, propylene glycol, 1,4-butanediol, 1,3-butanediol, 2-methyl-1,3-propanediol, 1,4-cyclohexanedimethanol, diethylene glycol, triethylene glycol, polyethylene glycol selected from the group consisting of PEG-200, PEG-300, PEG-400, and PEG-600; 2-methoxyethanol, 2-ethoxyethanol, 2-propoxyethanol, 2-isopropoxyethanol, 2-butoxyethanol, 1-methoxy-2-propanol, 1-ethoxy-2-propanol, 3-methoxy-1-butanol, diethylene glycol monomethyl ether, diethylene glycol monoethyl ether, diethylene glycol mono-n-propyl ether, diethylene glycol mono-i-propyl ether, diethylene glycol monobutyl ether, triethylene glycol monomethyl ether, dioxane, glycerol, 3-methoy-1,2-propanediol, 3-ethoxy-1,2-propanediol, and mixtures of these solvents.

3. The stabilized solution of claim 1 wherein said hydroxy-containing organic solvent is selected from the group consisting of 2-propanol, 2-isopropoxyethanol, diethylene glycol, ethylene glycol, propylene glycol, PEG-200 and mixtures of these solvents.

4. The stabilized solution of claim 1 wherein said solution comprises from about 15 to 35 weight percent of an alkali metal or alkaline earth metal salt of N-ethyl-N-2-(methanesulfonylaminoethyl)-2-methyl-p-phenylenediamine based on the total weight of the stabilized solution.

5. The stabilized solution of claim 1 wherein said solution comprises from about 1 to about 30 weight percent of a preservative.

6. The stabilized solution of claim 1 wherein said solution comprises from about 2 to about 15 weight percent of a preservative.

7. The stabilized solution of claim 1 wherein said preservative is selected from the group consisting of sodium sulfite, potassium sulfite, sodium bisulfite, potassium bisulfite, sodium metabisulfite, potassium metabisulfite, carbonyl-sulfite adducts, hydroxylamines, N,N-disubstituted hydroxylamines, hydroxamic acids, hydrazines, hydrazides, aminoketones, phenols, amino acids, mono- and polysaccharides, mono-, di-, and polyamines, ascorbic acid, alcohols, oximes, nitroxy radicals and mixtures of these preservatives.

8. The stabilized solution of claim 7 wherein said preservative is selected from the group consisting of N,N-dialkylhydroxylamine, N,N-diethylhydroxylamine, ascorbic acid, erythrobic acid, sodium sulfite, potassium sulfite, and mixtures of these preservatives.

9. A stabilized solution of an alkali metal or alkaline earth metal salt of a p-phenylenediamine color developer consisting essentially of:

a. from about 10 to 40 weight percent of an alkali metal or alkaline earth metal salt of N-ethyl-N-2-(methane sulfonylaminoethyl)-2-methyl-p-phenylenediamine;

b. from about 30 to 70 weight percent of at least one photographically inactive water-miscible or water-soluble hydroxy-containing, organic solvent of the alkali metal or alkaline earth metal salt of N-ethyl-N-2-(methane sulfonylaminoethyl)-2-methyl-p-phenylenediamine;

c. from about 5 to 40 weight percent water; and d. from about 1 to 40 weight percent of a preservative for the alkali metal or alkaline earth metal salt of N-ethyl-N-2-(methane sulfonylaminoethyl)-2-methyl-p-phenylenediamine and wherein the weight percentages are based on the total weight of the stabilized solution.

10. The stabilized solution of claim 9 wherein said hydroxy-containing organic solvent is selected from the group consisting of 2-propanol, 2-isopropoxyethanol, diethylene glycol, ethylene glycol, propylene glycol, PEG-200 and mixtures of these solvents.

11. The stabilized solution of claim 9 wherein said solution comprises from about 1 to about 30 weight percent of a preservative.

12. The stabilized solution of claim 9 wherein said preservative is selected from the group consisting of N,N-dialkylhydroxylamine, N,N-diethylhydroxylamine, ascorbic acid, erythrobic acid, sodium sulfite, potassium sulfite, and mixtures of these preservatives.

13. A stabilized solution of an alkali metal or alkaline earth metal salt of a p-phenylenediamine color developer comprising:

a. from about 10 to 40 weight percent of an alkali metal or alkaline earth metal salt of N-ethyl-N-2-(methane sulfonylaminoethyl)-2-methyl-p-phenylenediamine b. from about 20 to 88 weight percent water; and c. from about 1 to 40 weight percent of a preservative for the alkali metal or alkaline earth metal salt of N-ethyl-N-2-(methane sulfonylaminoethyl)-2-methyl-p-phenylenediamine, wherein the weight percentages are based on the total weight of said stabilized solution.

14. The stabilized solution of claim 13 wherein said water is from about 15 to 75 weight percent.

15. The stabilized solution of claim 13 said solution comprises from about 15 to 35 weight percent of an alkali metal or alkaline earth metal salt of N-ethyl-N-2-(methanesulfonylaminoethyl)-2-methyl-p-phenylenediamine based on the total weight of the stabilized solution.

16. The stabilized solution of claim 13 wherein said solution comprises from about 1 to about 30 weight percent of a preservative.

17. The stabilized solution of claim 13 wherein said solution comprises from about 2 to about 15 weight percent of a preservative.

18. The stabilized solution of claim 13 said preservative is selected from the group consisting of N,N-dialkylhydroxylamine, N,N-diethylhydroxylamine, ascorbic acid, erythrobic acid, sodium sulfite, potassium sulfite, and mixtures of these preservatives.

19. A process for preparing a stabilized solution of an alkali metal or alkaline earth metal salt of N-ethyl-N-2-(methanesulfonylaminoethyl)-2-methyl-p-phenylenediamine comprising the steps of:

a. hydrogenating 4-nitroso-3-methyl-N-ethyl-N-2-(methanesulfonylaminoethyl) aniline under hydrogenation conditions of pressure and temperature and in the presence of a heterogeneous, hydrogenation catalyst and at least one photographically inactive, water-miscible or water-soluble, hydroxy-containing, organic solvent to obtain a mixture of the heterogeneous catalyst in a first solution having N-ethyl-N-2-(methanesulfonylaminoethyl)-2-methyl-p-phenylenediamine and solvent;

b. separating the heterogeneous catalyst from the first solution;

c. adding water and an alkali metal or alkaline earth metal hydroxide and/or carbonate to the first solution to obtain a second solution comprising an alkali metal or alkaline earth metal salt of N-ethyl-N-2-(methanesulfonylaminoethyl)-2-methyl-p-phenylenediamine in the solvent and water; and d. adding a preservative, antioxidant or combination thereof for the alkali metal or alkaline earth metal salt of N-ethyl-N-2-(methanesulfonylaminoethyl)-2-methyl-p-phenylenediamine to the second solution.

20. The process of claim 19 wherein said hydroxy-containing organic solvent is selected from the group consisting of 1-propanol, 2-propanol, 1-butanol, 2-butanol, 2-methyl-1-propanol, 1-pentanol, 2-pentanol, 3-methyl-1-butanol, and 3-methyl-2-butanol, ethylene glycol, propylene glycol, 1,4-butanediol, 1,3-butanediol, 2-methyl-1,3-propanediol, 1,4-cyclohexanedimethanol, diethylene glycol, triethylene glycol, polyethylene glycol selected from the group consisting of PEG-200, PEG-300, PEG-400, and PEG-600; 2-methoxyethanol, 2-ethoxyethanol, 2-propoxyethanol, 2-isopropoxyethanol, 2-butoxyethanol, 1-methoxy-2-propanol, 1-ethoxy-2-propanol, 3-methoxy-1-butanol, diethylene glycol monomethyl ether, diethylene glycol monoethyl ether, diethylene glycol mono-n-propyl ether, diethylene glycol mono-i-propyl ether, diethylene glycol monobutyl ether, triethylene glycol monomethyl ether, dioxane, glycerol, 3-methoy-1,2-propanediol, 3-ethoxy-1,2-propanediol, and mixtures of these solvents.

21. The process of claim 19 wherein said hydroxy-containing organic solvent is selected from the group consisting of 2-propanol, 2-isopropoxyethanol, diethylene glycol, ethylene glycol, propylene glycol, PEG-200 and mixtures of these solvents.

22. The process of claim 19 wherein from about 0 to about 3 parts by weight water per part by weight of solution of N-ethyl-N-2-(methanesulfonylaminoethyl)-2-methyl-p-phenylenediamine in the hydrogenation solvent is added to said first solution.

23. The process of claim 19 wherein said alkali metal or alkaline earth metal hydroxide is selected from the group consisting of sodium hydroxide, potassium hydroxide and mixtures thereof.

24. The process of claim 23 wherein from about 1 to 1.5 equivalents of base per mole of N-ethyl-N-2-

(methanesulfonylaminoethyl)-2-methyl-p-phenylenediamine is added to said first solution.

25. The process of claim 19 wherein said preservative is selected from the group consisting of sodium sulfite, potassium sulfite, sodium bisulfite, potassium bisulfite, sodium metabisulfite, potassium metabisulfite, carbonyl-sulfite adducts, hydroxylamines, N,N-disubstituted hydroxylamines, hydroxamic acids, hydrazines, hydrazides, aminoketones, phenols, amino acids, mono- and polysaccharides, mono-, di-, and polyamines, ascorbic acid, alcohols, oximes, nitroxy radicals and mixtures of these preservatives.

26. The process of claim 19 wherein said preservative is selected from the group consisting of N,N-dialkylhydroxylamine, N,N-diethylhydroxylamine, ascorbic acid, erythrobic acid, sodium sulfite, potassium sulfite, and mixtures of these preservatives.

27. A process for preparing a stabilized aqueous solution of an alkali metal or alkaline earth metal salt of N-ethyl-N-2-(methanesulfonylaminoethyl)-2-methyl-p-phenylenediamine comprising the steps of:

a. hydrogenating 4-nitroso-3-methyl-N-ethyl-N-2-(methanesulfonylaminoethyl) aniline under hydrogenation conditions of pressure and temperature and in the presence of a heterogeneous, hydrogenation catalyst and a solvent selected from alkanols containing 1 to 6 carbon atoms, ethers containing 2 to 6 carbon atoms and mixtures thereof to obtain a mixture of the heterogeneous catalyst in a first solution having N-ethyl-N-2-(methanesulfonylaminoethyl)-2-methyl-p-phenylenediamine and solvent;

b. separating the heterogeneous catalyst from the first solution;

c. adding water and an alkali metal or alkaline earth metal hydroxide and/or carbonate to the first solution to obtain a second solution comprising an alkali metal or alkaline earth metal salt of N-ethyl-N-2-(methanesulfonylaminoethyl)-2-methyl-p-phenylenediamine in the solvent and water;

d. heating the second solution to distill the solvent; and e. adding a preservative, antioxidant or combination thereof for the alkali metal or alkaline earth metal salt of N-ethyl-N-2-(methanesulfonylaminoethyl)-2-methyl-p-phenylenediamine to the product of at least one of the steps (a)-(d).

28. The process of claim 27 wherein from about 0 to about 3 parts by weight water per part by weight of solution of N-ethyl-N-2-(methanesulfonylaminoethyl)-2-methyl-p-phenylenediamine in the hydrogenation solvent is added to said first solution.

29. The process of claim 27 wherein said alkali metal or alkaline earth metal hydroxide is selected from the group consisting of sodium hydroxide, potassium hydroxide and mixtures thereof.

30. The process of claim 29 wherein from about 1 to 1.5 equivalents of base per mole of N-ethyl-N-2-(methanesulfonylaminoethyl)-2-methyl-p-phenylenediamine is added to said first solution.

31. The process of claim 27 wherein said preservative is selected from the group consisting of sodium sulfite, potassium sulfite, sodium bisulfite, potassium bisulfite, sodium metabisulfite, potassium metabisulfite, carbonyl-sulfite adducts, hydroxylamines, N,N-disubstituted hydroxylamines, hydroxamic acids, hydrazines, hydrazides, aminoketones, phenols, amino acids, mono- and polysaccharides, mono-, di-, and polyamines, ascorbic acid, alcohols, oximes, nitroxy radicals and mixtures of these preservatives.

32. The process of claim 27 wherein said solvent is selected from the group consisting of methanol, ethanol, tetrahydrofuran, 1-propanol, 2-propanol and mixtures thereof.

33. A process for preparing a stabilized aqueous solution of an alkali metal or alkaline earth metal salt of N-ethyl-N-2-(methanesulfonylaminoethyl)-2-methyl-p-phenylenediamine comprising the steps of:

a. hydrogenating 4-nitroso-3-methyl-N-ethyl-N-2-(methanesulfonylaminoethyl) aniline under hydrogenation conditions of pressure and temperature and in the presence of a heterogeneous, hydrogenation catalyst and a solvent selected from alkanols containing 1 to 6 carbon atoms, ethers containing 2 to 6 carbon atoms and mixtures thereof to obtain a mixture of the heterogeneous catalyst in a first solution having N-ethyl-N-2-(methanesulfonylaminoethyl)-2-methyl-p-phenylenediamine and solvent;

b. separating the heterogeneous catalyst from the first solution;

c. crystallizing the N-ethyl-N-2-(methanesulfonylaminoethyl)-2-methyl-p-phenylenediamine to form a crystalline product;

d. recovering the crystalline product from the solvent;

e. adding water and an alkali metal or alkaline earth metal hydroxide and/or carbonate to the crystalline product to obtain a second solution comprising an alkali metal or alkaline earth metal salt of N-ethyl-N-2-(methanesulfonylaminoethyl)-2-methyl-p-phenylenediamine in water; and f. adding a preservative, antioxidant or combination thereof for the alkali metal or alkaline earth metal salt of N-ethyl-N-2-(methane-sulfonyl--amino-ethyl)-2-methyl-p-phenylenediamine to the second solution.

34. The process of claim 33 wherein from about 0 to about 3 parts by weight water per part by weight of solution of N-ethyl-N-2-(methanesulfonylaminoethyl)-2-methyl-p-phenylenediamine in the hydrogenation solvent is added to said first solution.

35. The process of claim 33 wherein said alkali metal or alkaline earth metal hydroxide is selected from the group consisting of sodium hydroxide, potassium hydroxide and mixtures thereof.

36. The process of claim 33 wherein from about 1 to 1.5 equivalents of base per mole of N-ethyl-N-2-(methanesulfonylaminoethyl)-2-methyl-p-phenylenediamine is added to said first solution.

37. The process of claim 33 wherein said preservative is selected from the group consisting of sodium sulfite, potassium sulfite, sodium bisulfite, potassium bisulfite, sodium metabisulfite, potassium metabisulfite, carbonyl-sulfite adducts, hydroxylamines, N,N-disubstituted hydroxylamines, hydroxamic acids, hydrazines, hydrazides, aminoketones, phenols, amino acids, mono- and polysaccharides, mono-, di-, and polyamines, ascorbic acid, alcohols, oximes, nitroxy radicals and mixtures of these preservatives.

38. The process of claim 33 wherein said solvent is selected from the group consisting of methanol, ethanol, tetrahydrofuran, 1-propanol, 2-propanol and mixtures thereof.

* * * * *